US012390018B2

(12) United States Patent
Dickinson

(10) Patent No.: US 12,390,018 B2
(45) Date of Patent: Aug. 19, 2025

(54) CONVERTIBLE CRIB

(71) Applicant: Shanna Dickinson, Branford, CT (US)

(72) Inventor: Shanna Dickinson, Branford, CT (US)

( * ) Notice: Subject to any disclaimer, the term of this patent is extended or adjusted under 35 U.S.C. 154(b) by 547 days.

(21) Appl. No.: 17/836,270

(22) Filed: Jun. 9, 2022

(65) Prior Publication Data

US 2022/0296005 A1 Sep. 22, 2022

Related U.S. Application Data

(63) Continuation-in-part of application No. 16/879,103, filed on May 20, 2020, now abandoned.

(60) Provisional application No. 62/850,166, filed on May 20, 2019.

(51) Int. Cl.

| | |
|---|---|
| ***A47D 9/00*** | (2006.01) |
| ***A47D 7/02*** | (2006.01) |
| ***A47D 7/03*** | (2006.01) |

(52) U.S. Cl.

CPC ..... *A47D 7/02* (2013.01); *A47D 7/03* (2013.01); *A47D 9/012* (2022.08)

(58) Field of Classification Search

CPC ... A47D 7/02; A47D 7/03; A47D 9/00; A47D 9/012; A47D 11/005; A47D 15/001

See application file for complete search history.

(56) References Cited

U.S. PATENT DOCUMENTS 318,111 A * 5/1885 Healey ..... A47D 13/06 5/93.1
730,391 A * 6/1903 Owen ..... A47C 19/022 5/53.2
1,173,954 A * 2/1916 Griffith ..... A47D 11/005 297/11
1,389,756 A * 9/1921 Hanley ..... A47C 17/18 5/55.1
2,477,231 A * 7/1949 Bourdon ..... A47D 11/007 5/100
3,327,328 A * 6/1967 Slivoski ..... A47C 19/04 5/53.1
3,427,666 A 2/1969 Saxe
3,634,894 A 1/1972 Harbison
4,361,919 A * 12/1982 Hull ..... A47D 11/007 5/2.1
5,163,190 A * 11/1992 Hwang ..... A47D 11/005 5/183
5,802,634 A * 9/1998 Onishi ..... A47G 1/06 5/93.1

(Continued)

OTHER PUBLICATIONS

Matthew Burak, "Your Definitive Guide to Removable Table Legs", TableLegs.com, St. Johnsbury, VT, USA, https://www.tablelegs.com/blog/definitive-guide-removable-table-legs.

(Continued)

*Primary Examiner* — Justin C Mikowski
*Assistant Examiner* — Ifeolu A Adeboyejo
(74) *Attorney, Agent, or Firm* — James G Passe; Passe Intellectual Property

(57) ABSTRACT

A rectangular, infant crib which can convert into various configurations, especially to allow for a parent to co-sleep with an infant, wherein the front wall is capable of folding downwards to a horizontal position and has a plurality of legs on the outer side of the front wall that are capable of folding down in a manner to support the front wall in the horizontal position.

6 Claims, 1 Drawing Sheet

(56) References Cited

U.S. PATENT DOCUMENTS

| | | | | |
|---|---|---|---|---|
| 6,550,082 | B2 | 4/2003 | Tharalson et al. | |
| 6,767,621 | B2 | 7/2004 | Flick et al. | |
| 6,862,757 | B2 | 3/2005 | Andriunas et al. | |
| 7,303,910 | B2 | 12/2007 | Bebbington et al. | |
| 8,365,324 | B2 | 2/2013 | Flannery | |
| 8,898,841 | B2 * | 12/2014 | Esch | A61G 7/065 5/655 |
| 2005/0034241 | A1 * | 2/2005 | Prince | A47D 15/001 5/690 |
| 2008/0052821 | A1 | 3/2008 | Morton | |
| 2008/0263764 | A1 * | 10/2008 | Jones | A47D 7/01 5/93.2 |
| 2017/0037215 | A1 * | 2/2017 | Crawford | A47C 7/40 |
| 2017/0156511 | A1 | 6/2017 | Curtis | |

OTHER PUBLICATIONS

Cronan, "Choosing Safe Baby Products: Changing Tables", KidsHealth, Jan. 2018, pp. 1-2, The Nemours Foundation, www.kidshealth.org.

Wikipedia, "Average Human Height by Country", www.wikipedia.com, pp. 1-28.

Mayo Clinic Staff, "Dwarfism", www.mayoclinic.org, Aug. 17, 2018, pp. 1-5, Book: Mayo Clinic Family Health 4 Book, 5th Edition.

* cited by examiner

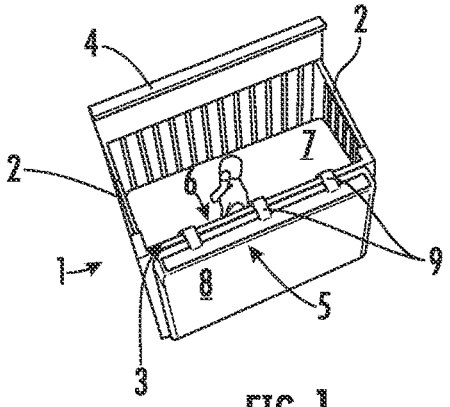
FIG. 1
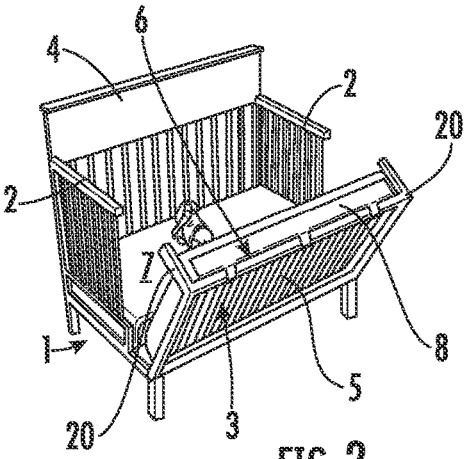
FIG. 2
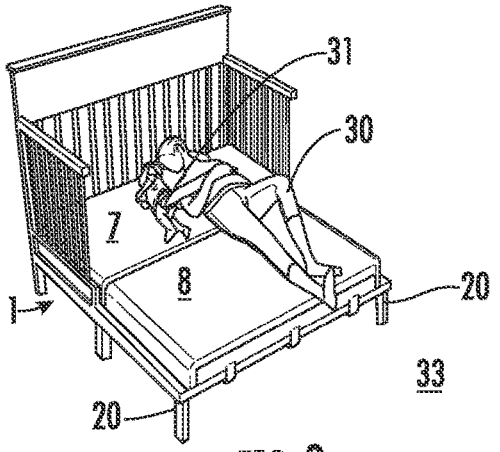
FIG. 3
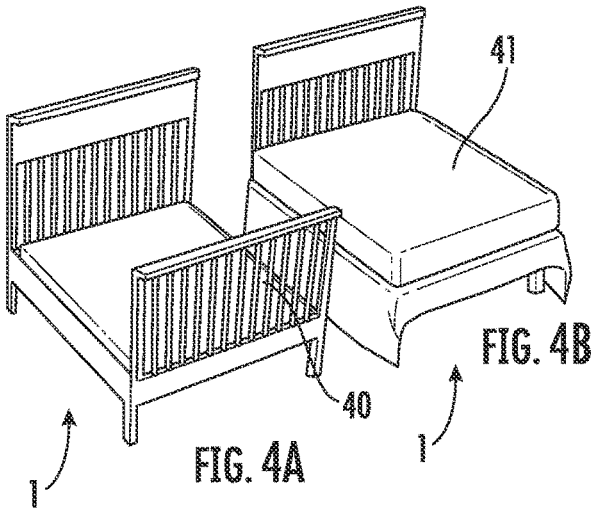
FIG. 4A
FIG. 4B

CONVERTIBLE CRIB

This application is a Continuation-in-Part of U.S. non-provisional application Ser. No. 16/879,103 filed on May 20, 2020, which claims priority to provisional application No. 62/850,166 filed on May 20, 2019, and which is incorporated herein in their entirety by reference.

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

Field of the Invention

The present invention relates to an infant crib. In particular, it relates to an infant crib which can convert into various configurations, especially for a parent co-sleeping with an infant.

Description of Related Art

The typical place for infants to sleep is in a crib. Typical cribs are rectangular with 4 walls to prevent the infant from falling out of the crib and usually the walls have bars so it is easy for the infant to see their parents. As infants grow, cribs can be limiting in size as that growth occurs. Cribs are used with infants at a stage when they require more physical contact than adults. Often the physical contact of a parent is all that's needed to comfort the child and help them fall asleep. It is difficult however, for parents, since the child is in a separate bed.

BRIEF SUMMARY OF THE INVENTION

The present invention relates to a crib with multiple configurations that can be used for co-sleeping with a full sized adult and can be configured to accommodate a child as they get bigger and have additional needs.

Accordingly, in one embodiment, there is a rectangular crib having a vertical long front and back wall and a vertical first and second side wall connecting the two long walls and having a first crib mattress of a first width comprising:

a) the front wall having an outer and inner side, the front wall capable of folding downwards to a horizontal position, such that the inner side is in the uppermost position;

b) a plurality of legs positioned on the outer side of the front wall in a manner to support the front wall in the horizontal position; and c) a co-sleeping second crib mattress of a second width for positioning on the front wall inner side when the front wall is in the horizontal position, wherein the first crib mattress and second crib mattress widths are of a combined width for parental co-sleeping in a full extended supine manner across the width of the first and second crib mattresses combined width, wherein the combined width is at least 5' and the plurality of legs are sufficient to support the weight of a child and parent at the same time.

BRIEF DESCRIPTION OF THE DRAWINGS

FIG. 1 is a perspective view showing a crib of the present invention.

FIG. 2 shows a perspective of a vertical long front wall of the crib being lowered and the second mattress flipped to an inside of the vertical long front wall.

FIG. 3 shows a perspective view of the configuration for co-sleeping.

FIGS. 4*a* and 4*b* show perspective views of two additional configurations possible of the present invention.

DETAILED DESCRIPTION OF THE INVENTION

While this invention is susceptible to embodiment in many different forms, there is shown in the drawings, and will herein be described in detail, specific embodiments with the understanding that the present disclosure of such embodiments is to be considered as an example of the principles and not intended to limit the invention to the specific embodiments shown and described. In the description below, like reference numerals are used to describe the same, similar, or corresponding parts in the several views of the drawings. This detailed description defines the meaning of the terms used herein and specifically describes embodiments in order for those skilled in the art to practice the invention.

Definitions

The terms "about" and "essentially" mean±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

Reference throughout this document to "one embodiment", "certain embodiments", "an embodiment", or similar terms means that a particular feature, structure, or characteristic described in connection with the embodiment is included in at least one embodiment of the present invention. Thus, the appearances of such phrases in various places throughout this specification are not necessarily all referring to the same embodiment. Furthermore, the particular features, structures, or characteristics may be combined in any suitable manner in one or more embodiments without limitation.

The term "or", as used herein, is to be interpreted as an inclusive or meaning any one or any combination. Therefore, "A, B, or C" means any of the following: "A; B; C; A and B; A and C; B and C; A, B, and C". An exception to this definition will occur only when a combination of elements, functions, steps, or acts are in some way inherently mutually exclusive.

The drawings featured in the figures are for the purpose of illustrating certain convenient embodiments of the present invention and are not to be considered as limitation thereto. The term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein, and use of the term "means" is not intended to be limiting.

As used herein, the term "crib" refers to an infant or small child's bed with a high enclosing, usually slatted, vertical sides or walls, and a first crib mattress. The crib is designed to be a size appropriate for the infant or child with walls high enough to prevent climbing out of the crib. The walls consist of two vertical long walls and two side walls which can be attached together or not, as design dictates. The crib of the present invention has one of the vertical long walls (the front wall) capable of folding down to a horizontal position.

As used herein, the term "vertical long wall" refers to the front and back wall of a crib. The front wall is the long wall closest to an observer. These vertical walls are long since the side walls are generally shorter than the vertical long walls. The front wall has an outer side, i.e., faces away from the crib interior, and an inner side which faces the first crib mattress.

As used herein, the term "side wall" refers to the shorter left and right vertical walls of the crib. These walls can be fixed, foldable, or removable as desired.

As used herein, the term "folding downwards" refers to the vertical long front wall being attached to the crib in a manner so that it can pivot from a vertical to a horizontal position. To prevent the top of the vertical long front wall from going past a horizontal position and the top rail resting on the floor, a pair of legs is attached in a manner to support the vertical long front wall in the horizontal position. Once folded into the horizontal position, the second crib mattress can be positioned on the inside of the wall (i.e., the wall is facing upward), as shown in the figures.

As used herein, the term "legs" refers to supports attached (permanent or removable and optionally foldable) to the front wall outer side to stop the travel of the front wall once it reaches the horizontal position. Once the second crib mattress is placed on the horizontal wall, the legs (and the wall) must support the second crib mattress, as well as support the adult and child resting on the expanded sleeping area.

As used herein, the term "first crib mattress" refers to a fabric case filled with deformable or resilient material, used for sleeping on. It can be the same type of material as the second crib mattress. In one embodiment, it is a breathable gel mattress.

As used herein, the term "additional wall" refers to one or more walls that can be added to the original crib in the expanded co-sleeping configuration to provide additional useful or decorative walls. See as an example FIG. 4*a*, where an additional wall is added to the foot of the "bed". The mattress can be totally separate from the crib or in one embodiment, attached to the front wall e.g., by attachment to the top rail of the vertical long front wall. When attached this way, the mattress can be flipped over to the inner side of the vertical long front wall in the horizontal position, as shown in the figures. In general, it is of a size that fits on the inside surface of the horizontally positioned vertical long front wall.

As used herein, the term "second crib mattress" refers to a mattress of a size that fits next to the first crib mattress. See FIG. 4*b* as an example. In this configuration, the bed is essentially an adolescent bed and no longer just a modified crib. The combined width of the first and second mattress is at least 5'0".

As used herein, the term "combined width for parental co-sleeping" refers to the combined width of the first crib mattress and width of the second crib mattress being at least 5'0" to accommodate an adult in a fully extended (see FIG. 3) supine manner. In one embodiment, the combined width is between 5'0" and 6'0" to accommodate an adult in the fully extended supine position.

DRAWINGS

Now referring to the drawings, FIG. 1 is a perspective view of the crib of the present invention. In this view, crib 1 consists of side walls 2 connected to vertical long front wall 3 and vertical long back wall 4. The vertical long front wall 3 has exterior side 5 and interior side 6. Inside the crib is first crib mattress 7, and hanging on the front wall 3 is second crib mattress 8 hung by straps 9. There are feet on the exterior side 5 of vertical long front wall 3, but not shown in this view because it is hidden behind the second crib mattress 8.

FIG. 2 shows the vertical long front wall being lowered to the horizontal position. The second crib mattress 8 has been flipped from the exterior side 5 to the interior of the vertical long front wall 3. Front legs 20 are shown not folded down, but are capable of being folded down to support the vertical long front wall in the horizontal position, as shown in the next figure.

FIG. 3 shows the crib 1 in the co-sleeping configuration with parent 30 in the supine position, and child 31 shown resting on both the width of first crib mattress 7 and the second crib mattress 8. The legs 20 have been folded to a down position in a manner to support the vertical long front wall 3 on the ground 33.

FIGS. 4*a* and 4*b* show perspective views of additional configurations made from the configuration shown in FIG. 3. In configuration 4*a*, an additional wall 40 is now positioned at the foot of the bed. In configuration 4*b*, a third crib mattress 41 is shown on top of first crib mattress 7 and second crib mattress 8.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials, and the like apparent to those skilled in the art still fall within the scope of the invention as claimed by the applicant.

What is claimed is:

1. A rectangular crib having a vertical long front and back wall and a vertical first and second side wall connecting the two long walls and having a first crib mattress of a first width comprising:

a) the front wall having an outer and inner side, the front wall capable of folding downwards to a horizontal position, such that the inner side is in the uppermost position;

b) a plurality of legs positioned on the outer side of the front wall in a manner to support the front wall in the horizontal position wherein the legs can support the weight of a child and an adult at the same time; and c) a co-sleeping second crib mattress of a second width for positioning on the front outer wall when the front wall is in the vertical position and wherein the second crib mattress moves to the inner wall of the front wall when it is in the horizontal position, wherein the first crib mattress and second crib mattress widths are of a combined width for parental co-sleeping in a full extended supine manner across the width of the first and second crib mattresses combined width, wherein the combined width is at least 5'.

2. The rectangular crib according to claim 1 wherein the first crib mattress is attached to a top rail of the front wall.

3. The rectangular crib according to claim 1 wherein the first crib mattress is a breathable gel mattress.

4. The rectangular crib according to claim 1 wherein the legs fold away when the front wall is in the vertical position.

5. The rectangular crib according to claim 1 wherein the legs positioned on the outer side of the front wall are removable.

6. The rectangular crib according to claim 1 wherein the combined width is from between 5'0" to 6'0".

* * * * *